US010537761B2

(12) United States Patent
Mull

(10) Patent No.: US 10,537,761 B2
(45) Date of Patent: Jan. 21, 2020

(54) MONITORED FIRE SUPPRESSION ASSEMBLY

(71) Applicant: Justin Mull, Glendale, AZ (US)

(72) Inventor: Justin Mull, Glendale, AZ (US)

( * ) Notice: Subject to any disclaimer, the term of this patent is extended or adjusted under 35 U.S.C. 154(b) by 76 days.

(21) Appl. No.: 15/994,244

(22) Filed: May 31, 2018

(65) Prior Publication Data

US 2019/0366138 A1 Dec. 5, 2019

(51) Int. Cl.

| | |
|---|---|
| ***A62C 35/68*** | (2006.01) |
| ***A62C 37/40*** | (2006.01) |
| *A62C 37/08* | (2006.01) |
| *A62C 35/60* | (2006.01) |
| *G08B 17/06* | (2006.01) |

(52) U.S. Cl.

CPC ..... *A62C 35/68* (2013.01); *A62C 37/40* (2013.01); *A62C 35/60* (2013.01); *A62C 37/08* (2013.01); *G08B 17/06* (2013.01)

(58) Field of Classification Search

CPC ..... A62C 35/68; A62C 37/40; A62C 35/60; A62C 37/08; G08B 17/06

USPC ..... 169/16, 23, 37, 56, 60, 61; 340/605, 340/606, 626

See application file for complete search history.

(56) References Cited

U.S. PATENT DOCUMENTS

| | | | | |
|---|---|---|---|---|
| D251,128 | S | 2/1979 | Groos et al. | |
| 4,984,637 | A | 1/1991 | Finnigan | |
| 6,333,695 | B2 | 12/2001 | Young | |
| 6,964,379 | B2 * | 11/2005 | Crowley | B05B 15/70 169/16 |
| 8,749,393 | B1 | 6/2014 | Tollefson | |
| 2004/0020663 | A1 * | 2/2004 | Jackson | A62C 35/68 169/20 |
| 2006/0272830 | A1 | 12/2006 | Fima | |
| 2014/0225741 | A2 | 8/2014 | Gritzo et al. | |
| 2017/0100617 | A1 | 4/2017 | Kochelek | |
| 2018/0200552 | A1 * | 7/2018 | Wertsberger | A62C 37/44 |

FOREIGN PATENT DOCUMENTS

| | | |
|---|---|---|
| WO | WO2015134914 | 9/2015 |

* cited by examiner

*Primary Examiner* — Steven J Ganey

(57) ABSTRACT

A monitored fire suppression assembly for preventing water damage includes a control valve that is coupled a water supply. A flow detector and a release valve are positioned proximate to the control valve in a piping network extending from the control valve. Each of a plurality of a sprinklers that is coupled to the piping network comprises a switch and a plug. The switch is operationally coupled to the plug so that release of the plug trips the switch. An alarm panel is operationally coupled to the flow detector, the release valve, the control valve, and the switch. Receipt of a flow signal from the flow detector, in an event the switch is not tripped, positions the alarm panel to actuate the control valve to cut off water to the sprinkler, and to actuate the release valve to drain the piping network via a tube extending from the release valve.

14 Claims, 5 Drawing Sheets

MONITORED FIRE SUPPRESSION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to fire suppression assemblies and more particularly pertains to a new fire suppression assembly for preventing unnecessary water damage.

BRIEF SUMMARY OF THE INVENTION

An embodiment of the disclosure meets the needs presented above by generally comprising a control valve that is coupled a water supply. A flow detector and a release valve are positioned proximate to the control valve in a piping network extending from the control valve. Each of a plurality of a sprinklers that is coupled to the piping network comprises a switch and a plug. The switch is operationally coupled to the plug so that release of the plug trips the switch. An alarm panel is operationally coupled to the flow detector, the release valve, the control valve, and the switch. Receipt of a flow signal from the flow detector, in an event the switch is not tripped, positions the alarm panel to actuate the control valve to cut off water to the sprinkler, and to actuate the release valve to drain the piping network via a tube extending from the release valve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
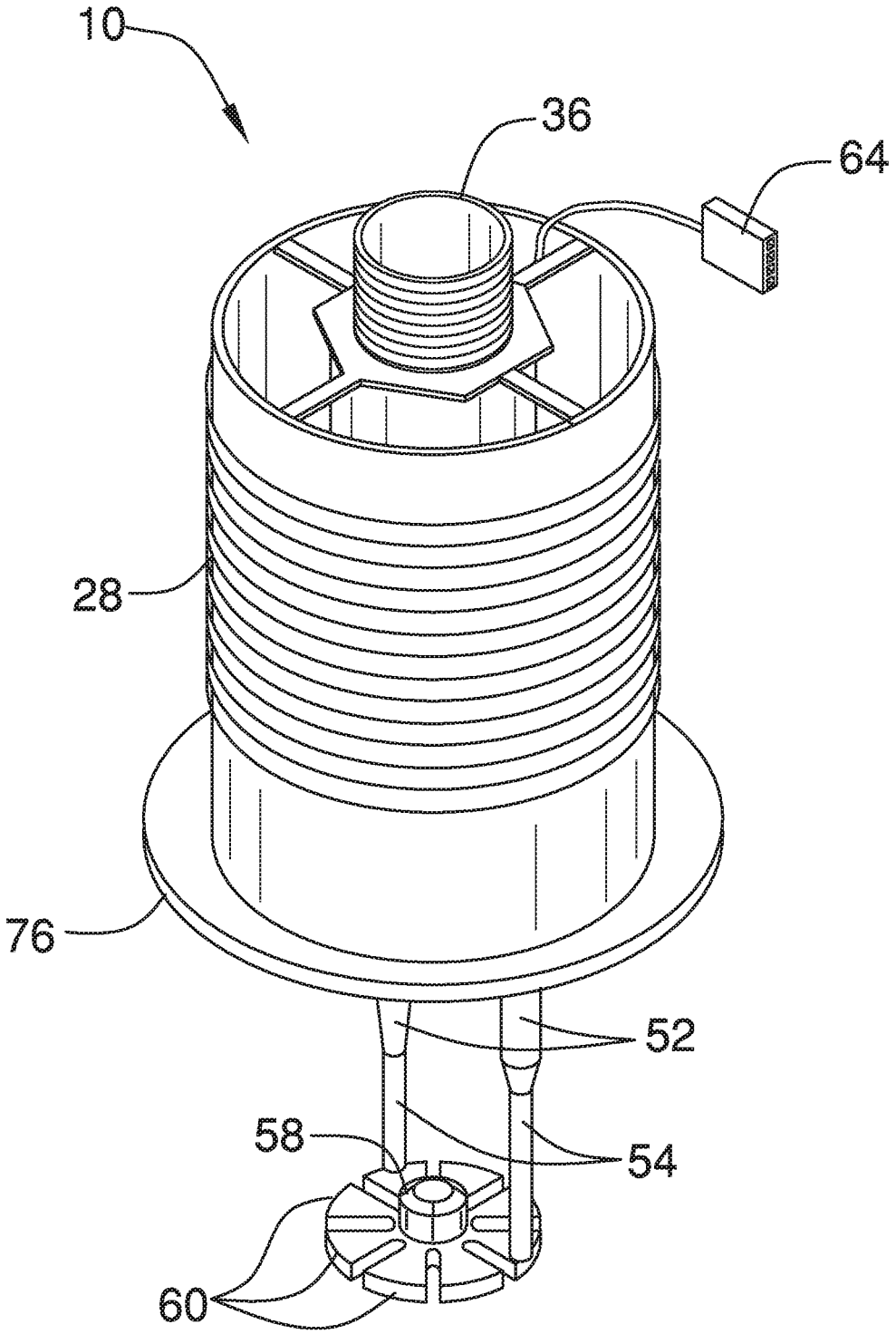
FIG. 1 is an isometric perspective view of a monitored fire suppression assembly according to an embodiment of the disclosure.

With reference now to the drawings, and in particular to FIGS. 1 through 6 thereof, a new fire suppression assembly embodying the principles and concepts of an embodiment of the disclosure and generally designated by the reference numeral 10 will be described.

Figure 6:
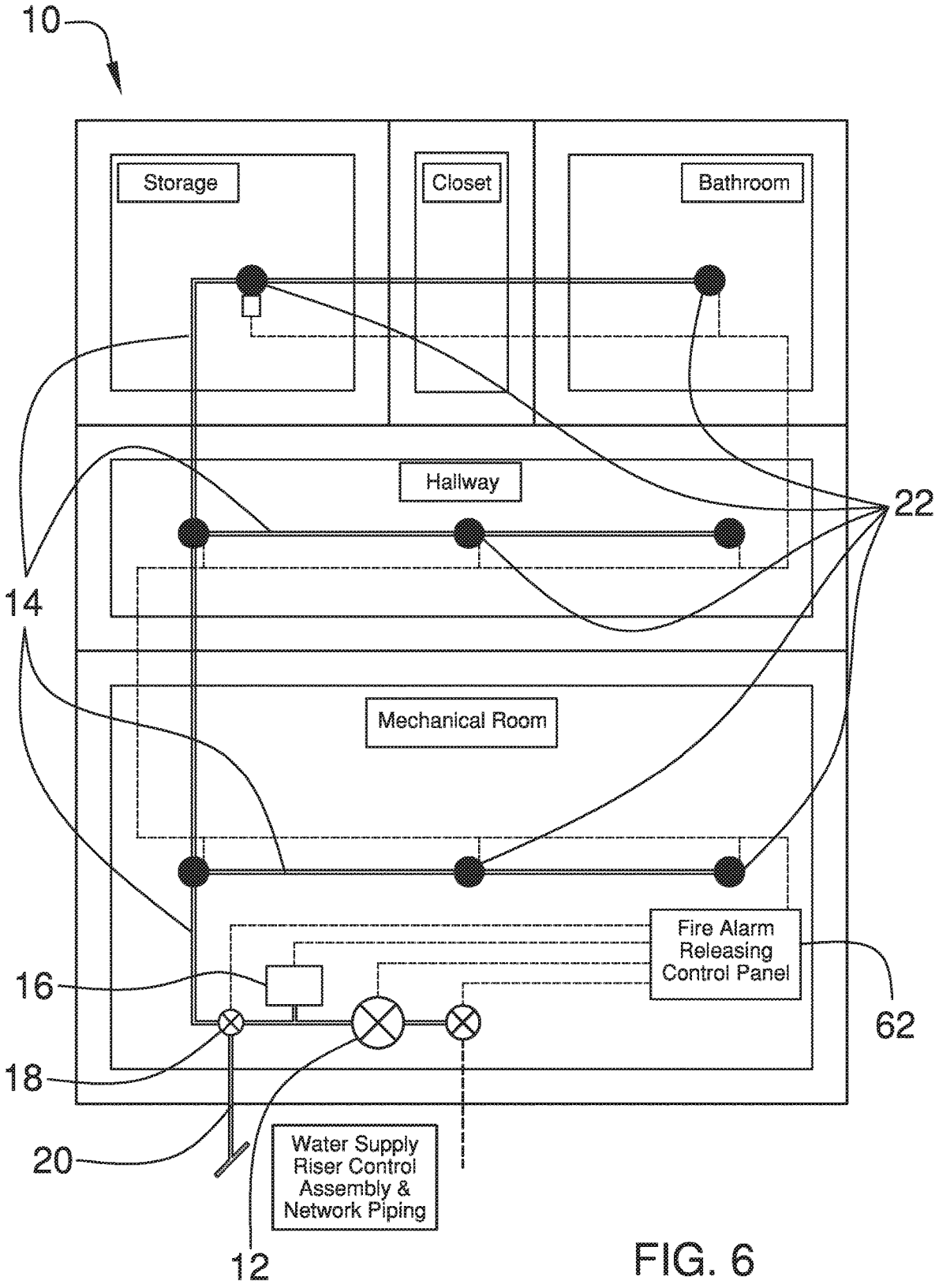
FIG. 6 is an in-use view of an embodiment of the disclosure.

As best illustrated in FIGS. 1 through 6, the monitored fire suppression assembly 10 generally comprises a control valve 12 that is coupled a water supply so that the control valve 12 is fluidically coupled to the water supply. The control valve 12 is electric actuated-type. A piping network 14 is coupled to and extends from the control valve 12, as shown in FIG. 6.

A flow detector 16 is positioned in the piping network 14 proximate to the control valve 12. A release valve 18 is positioned in the piping network 14 proximate to the flow detector 16. The release valve 18 is electric activated solenoid type. A tube 20 is coupled to the release valve 18 and extends to a drain.

Figure 3:
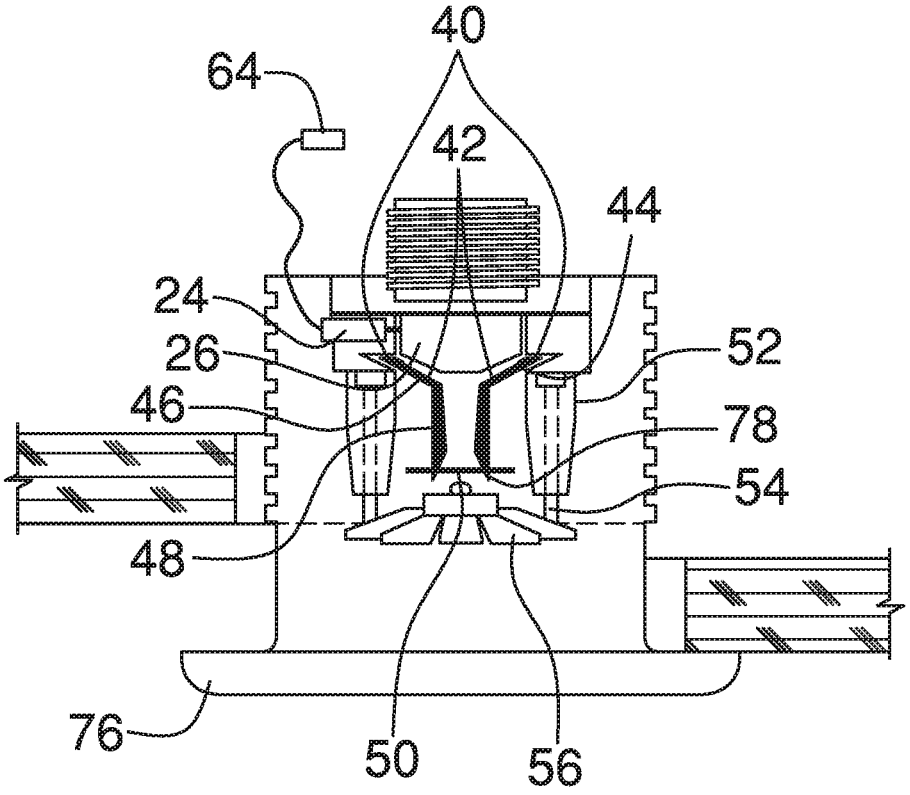
FIG. 3 is a cross-sectional of an embodiment of the disclosure.

A plurality of a sprinklers 22 is coupled to the piping network 14 so that the sprinklers 22 are in selective fluidic communication with the water supply, as shown in FIG. 6. Each sprinkler 22 comprises a switch 24 and a plug 26, as shown in FIG. 3. The switch 24 is operationally coupled to the plug 26 so that release of the plug 26 to spray water to suppress a fire trips the switch 24. The switch 24 is low-voltage, high-temperature type.

Each sprinkler 22 also comprises a head cup 28 that is tubular. The head cup 28 has a top 30 and a bottom 32. The top 30 is closed. The bottom 32 is open. An orifice 34 centrally positioned in the top 30.

Figure 2:
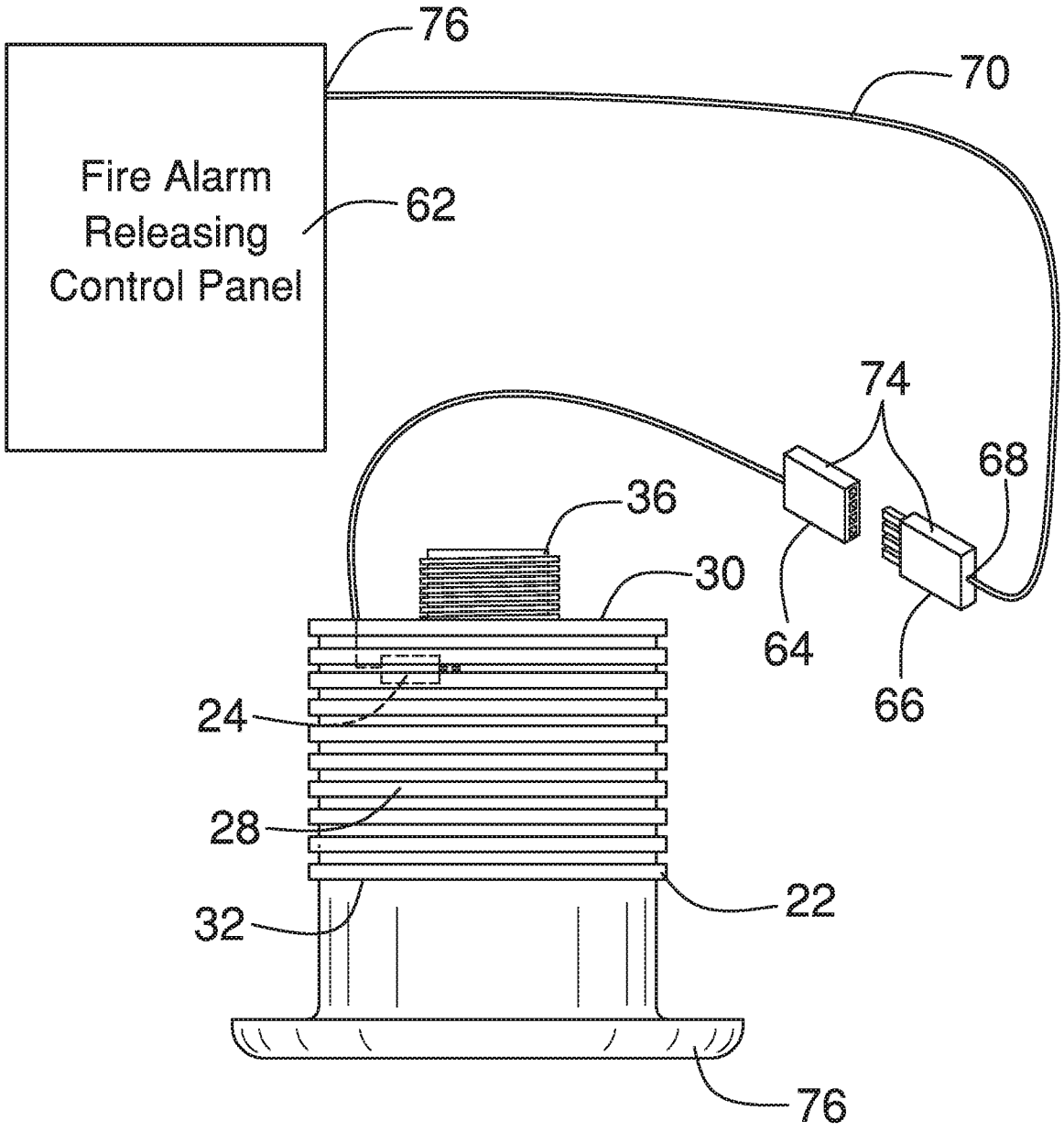
FIG. 2 is a side view of an embodiment of the disclosure.

A pipe 36 is coupled to the top 30 and extends the head cup 28. The pipe 36 extends from the orifice 34. The pipe 36 is externally threaded, as shown in FIG. 2. The pipe 36 is positioned to threadedly couple to the piping network 14 to couple the sprinkler 22 to the piping network 14.

A pair of blocks 38 is coupled to and positioned in the head cup 28, as shown in FIG. 3. The pair of blocks 38 is opposingly positioned adjacent to the orifice 34. The plug 26 is positioned between the pair of blocks 38 and is positioned to stop a flow of water from the piping network 14.

Each of a pair of slots 40 extends into an associated block 38 adjacent to the plug 26, as shown in FIG. 3. The slots 40 are triangularly shaped. Each of a pair of arms 42 has a first terminus 44 that positioned in a respective slot 40. The arm 42 is beveled adjacent to the first terminus 44 so that the first terminus 44 is complementary to the respective slot 40. Each arm 42 comprises a first section 46 and a second section 48. The first section 46 extends from the first terminus 44. The second section 48 extends transversely from the first section 46 so that the second section 48 is substantially perpendicular to the top 30 of the head cup 28.

A fusible link 50 is coupled to a second terminus 78 of each arm 42 so that the fusible link 50 extends between the arms 42, as shown in FIG. 3. The arms 42 are positioned to retain the plug 26 in the pair of blocks 38. The fusible link 50 is positioned to be thermally severed so that the arms 42 release from the slots 40 to release the plug 26.

Figure 4:
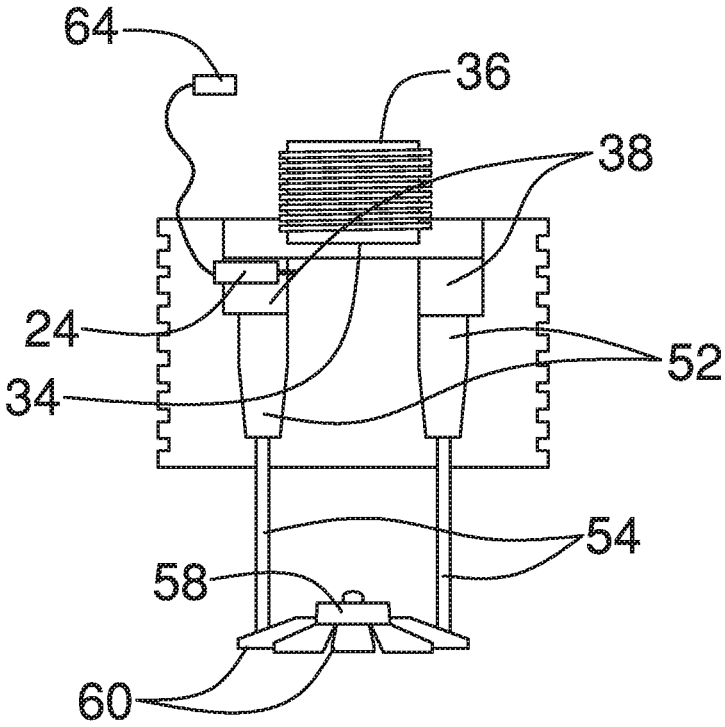
FIG. 4 is a cross-sectional of an embodiment of the disclosure.
Figure 5:
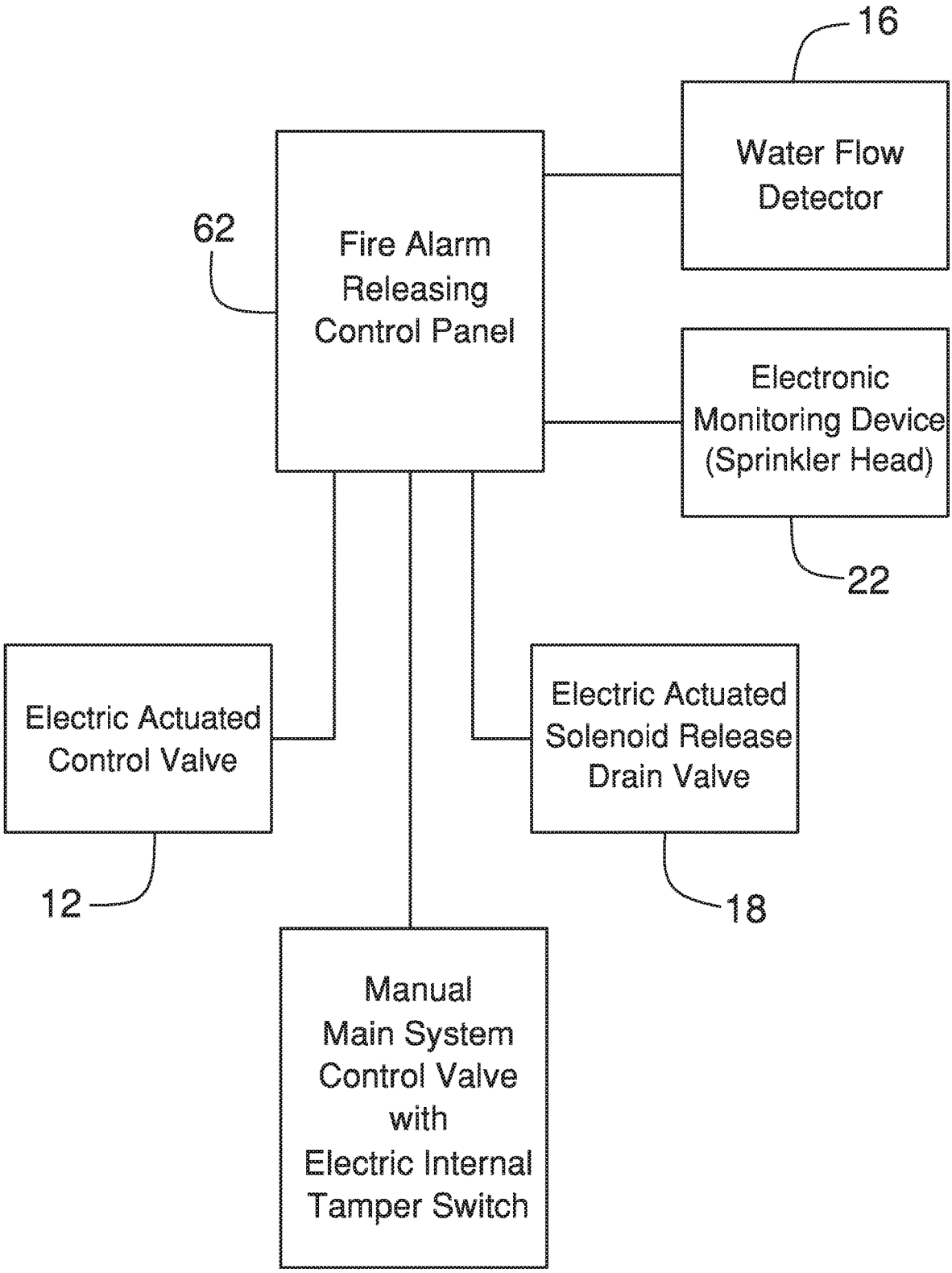
FIG. 5 is a block diagram of an embodiment of the disclosure.

Each of a pair of outer rods 52 is coupled to and extends perpendicularly from a respective block 38. Each of a pair of inner rods 54 is selectively extensible from an associated outer rod 52, as shown in FIG. 4. The inner rod 54 is removably coupled to the first terminus 44 of an associated arm 42 so that the inner rod 54 is positioned to extend from the associated outer rod 52 upon thermal severing of the fusible link 50.

A plate 56 is coupled to and extends between the inner rods 54 distal from the pair of blocks 38. The plate 56 is positioned to disperse the water spraying from the sprinkler 22. The plate 56 comprises a hub 58 and a plurality of blades 60, as shown in FIG. 4. Each blade 60 is coupled to and extends radially from the hub 58.

An alarm panel 62 is operationally coupled to the flow detector 16, the release valve 18, the control valve 12, and the switch 24, as shown in FIG. 6. The alarm panel 62 is positioned to receive a flow signal from the flow detector 16, positioning the alarm panel 62 to selectively actuate the control valve 12 to decouple the piping network 14 from the water supply and to selectively actuate the release valve 18 to couple the piping network 14 to the tube 20 in an event the switch 24 has not been tripped. The alarm panel 62 is wiredly coupled to the switch 24.

The assembly 10 protects a structure from unnecessary water damage from a broken pipe 36 or a malfunctioning sprinkler 22 by decoupling the piping network 14 from the water supply and draining water from the piping network 14 through the tube 20 to a drain.

Should the plug 26 subsequently trip the switch 24, indicating a fire, the alarm panel 62 is positioned to actuate the control valve 12 to couple the piping network 14 back to the water supply so that water flows to the sprinkler 22 to suppress the fire. The present invention also anticipates a battery backup system being coupled to the alarm panel 62 so that the assembly 10 is operable during a power outage.

A first connector 64 is coupled to the switch 24, as shown in FIG. 2. A second connector 66 is coupled to a first end 68 of a wire 70. The wire 70 has a second end 72 that operationally coupled to the alarm panel 62. The second connector 66 is complementary to the first connector 64. The second connector 66 is positioned to couple to the first connector 64 to operationally couple the switch 24 to the alarm panel 62. The first connector 64 and the second connector 66 comprise a pigtail connector 74. The pigtail connector 74 is four-pin type.

An escutcheon plate 76 is coupled to and extends radially from the bottom 32 of the head cup 28, as shown in FIG. 3. The escutcheon plate 76 is configured to cover a gap between the sprinkler 22 and a ceiling panel, as shown in FIG. 3. The escutcheon plate 76 is threadedly couplable to the head cup 28 so that the escutcheon plate 76 is selectively positionable relative to the bottom 32 of the head cup 28. This configuration accommodates various degrees of protrusion of the head cup 28 from the ceiling panel.

In use, the assembly 10 would operate under normal conditions to suppress the fire in the structure. Should the flow detector 16 signal the alarm panel 62 of the flow of the water from the water supply, but the switch 24 has not been tripped, the alarm panel 62 would actuate the control valve 12 to decouple the piping network 14 from the water supply to stop the flow of water into the structure from the broken pipe 36 or malfunctioning sprinkler 22. The alarm panel 62 would actuate the release valve 18 to couple the piping network 14 to the tube 20 to drain the water from the piping network 14 through the tube 20 to the drain. Further, upon activation of a sprinkler 22 after the control valve 12 has been decoupled from the piping network 14, the alarm panel 62 actuates the control valve 12 to couple the piping network 14 to the water supply so that water flows to the sprinkler 22 to suppress the fire.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A monitored fire suppression assembly comprising:

a control valve coupled a water supply such that the control valve is fluidically coupled to the water supply;

a piping network coupled to and extending from the control valve;

a flow detector positioned in the piping network proximate to the control valve;

a release valve positioned in the piping network proximate to the flow detector;

a tube coupled to the release valve and extending to a drain;

a plurality of a sprinklers coupled to the piping network such that the sprinklers are in selective fluidic communication with the water supply, each sprinkler comprising a switch and a plug, the switch being operationally coupled to the plug wherein release of the plug for spraying water for suppressing a fire trips the switch; and an alarm panel operationally coupled to the flow detector, the release valve, the control valve, and the switch wherein the alarm panel is positioned for receiving a flow signal from the flow detector positioning the alarm panel for selectively actuating the control valve for decoupling the piping network from the water supply and the release valve for coupling the piping network to the tube in an event the switch not be tripped.

2. The assembly of claim 1, further including the control valve being electric actuated-type.

3. The assembly of claim 1, further including the release valve being electric activated solenoid type.

4. The assembly of claim 1, further including the switch being low-voltage, high-temperature type.

5. The assembly of claim 1, further including each sprinkler comprising:

a head cup, the head cup being tubular, the head cup having a top and a bottom, the top being closed, the bottom being open;

an orifice centrally positioned in the top;

a pipe coupled to the top and extending the head cup, the pipe extending from the orifice, the pipe being externally threaded wherein the pipe is positioned for threadedly coupling to the piping network for coupling the sprinkler to the piping network;

a pair of blocks coupled to and positioned in the head cup, the pair of blocks opposingly positioned adjacent to the orifice, the plug being positioned between the pair of blocks wherein the plug is positioned for stopping a flow of water from the piping network, a pair of slots, each slot extending into an associated block adjacent to the plug, the slots being triangularly shaped;

a pair of arms, each arm having a first terminus positioned in a respective slot, the arm being beveled adjacent to the first terminus such that the first terminus is complementary to the respective slot;

a fusible link coupled to a second terminus of each arm such that the fusible link extends between the arms wherein the arms are positioned for retaining the plug in the pair of blocks, wherein the fusible link is positioned for thermal severing such that the arms release from the slots for releasing the plug;

a pair of outer rods, each outer rod being coupled to and extending perpendicularly from a respective block;

a pair of inner rods, each inner rod being selectively extensible from an associated outer rod, the inner rod being removably coupled to the first terminus of an associated arm wherein the inner rod is positioned for extending from the associated outer rod upon thermal severing of the fusible link; and a plate coupled to and extending between the inner rods distal from the pair of blocks wherein the plate is positioned for dispersing the water spraying from the sprinkler.

6. The assembly of claim 5, further including each arm comprising a first section and a second section, the first section extending from the first terminus, the second section extending transversely from the first section such that the second section is substantially perpendicular to the top of the head cup.

7. The assembly of claim 5, further including the plate comprising a hub and a plurality of blades, each blade being coupled to and extending radially from the hub.

8. The assembly of claim 1, further including the alarm panel being wiredly coupled to the switch.

9. The assembly of claim 8, further comprising:

a first connector coupled to the switch; and a second connector coupled to a first end of a wire, the wire having a second end operationally coupled to the alarm panel, the second connector being complementary to the first connector wherein the second connector is positioned for coupling to the first connector for operationally coupling the switch to the alarm panel.

10. The assembly of claim 9, further including the first connector and the second connector comprising a pigtail connector.

11. The assembly of claim 10, further including the pigtail connector being four-pin type.

12. The assembly of claim 1, further including an escutcheon plate coupled to and extending radially from the bottom of the head cup wherein the escutcheon plate is configured for covering a gap between the sprinkler and a ceiling panel.

13. The assembly of claim 12, further including the escutcheon plate being threadedly couplable to the head cup wherein the escutcheon plate is selectively positionable relative to the bottom of the head cup.

14. A monitored fire suppression assembly comprising:

a control valve coupled a water supply such that the control valve is fluidically coupled to the water supply, the control valve being electric actuated-type;

a piping network coupled to and extending from the control valve;

a flow detector positioned in the piping network proximate to the control valve;

a release valve positioned in the piping network proximate to the flow detector, the release valve being electric activated solenoid type;

a tube coupled to the release valve and extending to a drain;

a plurality of a sprinklers coupled to the piping network such that the sprinklers are in selective fluidic communication with the water supply, each sprinkler comprising a switch and a plug, the switch being operationally coupled to the plug wherein release of the plug for spraying water for suppressing a fire trips the switch, the switch being low-voltage, high-temperature type, each sprinkler comprising:

a head cup, the head cup being tubular, the head cup having a top and a bottom, the top being closed, the bottom being open, an orifice centrally positioned in the top, a pipe coupled to the top and extending the head cup, the pipe extending from the orifice, the pipe being externally threaded wherein the pipe is positioned for threadedly coupling to the piping network for coupling the sprinkler to the piping network, a pair of blocks coupled to and positioned in the head cup, the pair of blocks opposingly positioned adjacent to the orifice, the plug being positioned between the pair of blocks wherein the plug is positioned for stopping a flow of water from the piping network, a pair of slots, each slot extending into an associated block adjacent to the plug, the slots being triangularly shaped, a pair of arms, each arm having a first terminus positioned in a respective slot, the arm being beveled adjacent to the first terminus such that the first terminus is complementary to the respective slot, each arm comprising a first section and a second section, the first section extending from the first terminus, the second section extending transversely from the first section such that the second section is substantially perpendicular to the top of the head cup, a fusible link coupled to a second terminus of each arm such that the fusible link extends between the arms wherein the arms are positioned for retaining the plug in the pair of blocks, wherein the fusible link is positioned for thermal severing such that the arms release from the slots for releasing the plug, a pair of outer rods, each outer rod being coupled to and extending perpendicularly from a respective block, a pair of inner rods, each inner rod being selectively extensible from an associated outer rod, the inner rod being removably coupled to the first terminus of an associated arm wherein the inner rod is positioned for extending from the associated outer rod upon thermal severing of the fusible link, and a plate coupled to and extending between the inner rods distal from the pair of blocks wherein the plate is positioned for dispersing the water spraying from the sprinkler, the plate comprising a hub and a plurality of blades, each blade being coupled to and extending radially from the hub;

an alarm panel operationally coupled to the flow detector, the release valve, the control valve, and the switch wherein the alarm panel is positioned for receiving a flow signal from the flow detector positioning the alarm panel for selectively actuating the control valve for decoupling the piping network from the water supply and the release valve for coupling the piping network to the tube in an event the switch not be tripped, the alarm panel being wiredly coupled to the switch;

a first connector coupled to the switch;

a second connector coupled to a first end of a wire, the wire having a second end operationally coupled to the alarm panel, the second connector being complementary to the first connector wherein the second connector is positioned for coupling to the first connector for operationally coupling the switch to the alarm panel, the first connector and the second connector comprising a pigtail connector, the pigtail connector being four-pin type; and an escutcheon plate coupled to and extending radially from the bottom of the head cup wherein the escutcheon plate is configured for covering a gap between the sprinkler and a ceiling panel, the escutcheon plate being threadedly couplable to the head cup wherein the escutcheon plate is selectively positionable relative to the bottom of the head cup.

* * * * *